United States Patent [19]

Bottos

[11] 4,037,285

[45] July 26, 1977

[54] BRUSH FOR CLEANING WHITEWALL TIRES

[76] Inventor: Bela Bottos, 1308 H Stone Mill Court, Stone Mountain, Ga. 30083

[21] Appl. No.: 660,993

[22] Filed: Feb. 24, 1976

[51] Int. Cl.[2] ..... A46B 9/02

[52] U.S. Cl. ..... 15/160; 15/143 R; 15/246

[58] Field of Search ..... 15/160, 210 R, 248, 15/21 R, 104.16, 143 R, 111

[56] References Cited

U.S. PATENT DOCUMENTS

| | | | |
|---|---|---|---|
| 509,237 | 11/1893 | Olsen et al. | 15/104.16 X |
| 711,777 | 10/1902 | Marqua | 15/248 R |
| 939,522 | 11/1909 | Lockwood | 15/248 R |
| 1,744,577 | 1/1930 | Robinette | 15/166 |
| D. 110,363 | 7/1938 | Racicot | 15/160 |

FOREIGN PATENT DOCUMENTS

| | | | |
|---|---|---|---|
| 376,531 | 8/1907 | France | 15/160 |
| 244,602 | 12/1925 | United Kingdom | 15/248 R |
| 739,184 | 10/1955 | United Kingdom | 15/248 |

*Primary Examiner*—Peter Feldman

*Attorney, Agent, or Firm*—Larson, Taylor and Hinds

[57] ABSTRACT

A brush for use in cleaning the whitewalls of tires which comprises edge guides attached to a curved base in which bristles are embedded and an arching handle that forms an acute angle with the plane of the base. The edge guides, base and handle are preferably of a flexible and resilient material.

4 Claims, 4 Drawing Figures

BRUSH FOR CLEANING WHITEWALL TIRES

FIELD OF THE INVENTION

The present invention relates to brushes for use in the cleaning of whitewalls of tires.

BACKGROUND OF THE INVENTION

As is well known to any owner of whitewall tires, the whitewall portion of the sidewall becomes soiled and discolored very rapidly upon exposure to the dirt and grease of the highway. Since whitewalls are placed on tires primarily for reason of appearance, this rapid discoloring and darkening of the whitewalls detract substantially from the value of having whitewall tires. Unfortunately, there has not been an easy way of efficiently removing these discoloring soilants and thereby retain the attractiveness of the whitewall tire.

Since most of the discoloring soilants are difficult to remove, an implement, such as a brush is necessary in restoring the attractiveness of the whitewall. However brushes of the prior art (see for instance U.S. Pat. Nos. 389,531 and 509,237) are not readily adapted to the efficient cleaning of a whitewall, due to the shape characteristics of the whitewalls and its position on the sidewall of the tire. The whitewall is recessed slightly from the sidewall of the tire to form a groove in the tire. Due to this groove it is imperative for the effective cleaning of the whitewall that the brush be the same dimension as the width of the whitewall and that it contain means for maintaining it in contact with the whitewall.

The problem of maintaining a brush in contact with the whitewall as it is guided around the tire is especially critical when the brush reaches the lower portion of the tire. This problem is created by the inability of the wrist to fully twist in concert with the brush which is revolving about the tire.

One solution to this difficulty in cleaning the whitewall of the tire has been proposed in U.S. Pat. No. 2,832,085 to Chamberlain. This patent discloses that a whitewall portion of a sidewall may be cleaned by dismounting the tire from the automobile and placing it on a base. A brush may then be mechanically revolved about the tire. The obvious disadvantage of this apparatus is that it requires the removal of the tire from the automobile for its utilization.

Another disadvantage of the brushes of the prior art is that they fail to facilitate the application of the full effective force that is being applied to the brush in cleaning the tire. Much of the power being expended by the use, especially at the bottom of the stroke, is wasted in continually maintaining the alignment of the brush with respect to the whitewall. Therefore, maximum efficient cleaning power is not attained which forces the user to exert greater energies than necessary in obtaining a whitewall which demonstrates desirable coloration.

It is an object of the present invention, therefore, to provide a device for the efficient cleaning of whitewall tires.

It is also an object of the present invention to provide a brush for cleaning whitewall tires which will fit into the grooves of the whitewalls so that the bristles are retained in contact with the whitewall and that the entire whitewall of a tire can be cleaned in a single step without necessitating removal of the brush from the groove.

It is also an object of this invention to provide a brush for cleaning whitewall tires having a base and pattern of bristles which conform to the curvature of the groove of the whitewall.

Another object of the present invention is to provide a brush for cleaning whitewall tires is easily grasped and controlled during use.

A further object of the invention is to provide a brush for cleaning whitewall tires requiring minimum energy input for effective utilization.

SUMMARY OF THE INVENTION

These and other objects are provided by a brush for cleaning the whitewalls of a tire that contains a groove for the whitewall having base means containing embedded bristles; handle means which are connected to the base at an acute angle; and means for guiding the base in the groove that contains the whitewall portion of the tire. Preferably the base means, handle means, and guide means are made of a flexible and resilient material. Also, the base means containing the embedded bristles may be curved to conform to the shape of the whitewall.

A feature of the present invention is that the entire whitewall can be cleaned in a single step, that is, without removal of the brush from the groove.

DETAILED DESCRIPTION OF THE DRAWINGS

Figure 1:
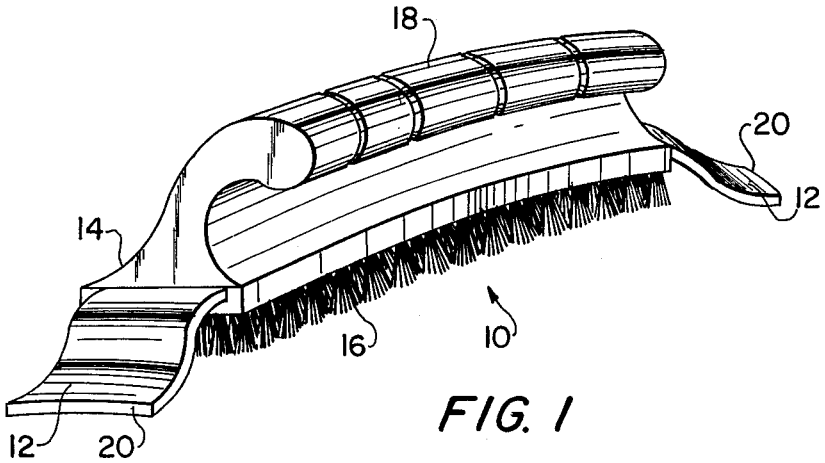
FIG. 1 is a plan view of the brush which comprises the invention.

Referring to FIG. 1, there is shown a brush 10 having edge guides 12, base 14, bristles 16 and handle 18. In the preferred embodiment of this invention edge guides 12, base 14, and handle 18 are made of flexible and resilient materials, for example elastomers and hard plastics. Edge guide 12 fits into the groove of the whitewall (not shown) because the width of side 20 does not exceed that of the groove, and thus the bristles are retained within the groove during cleaning.

Figure 2:
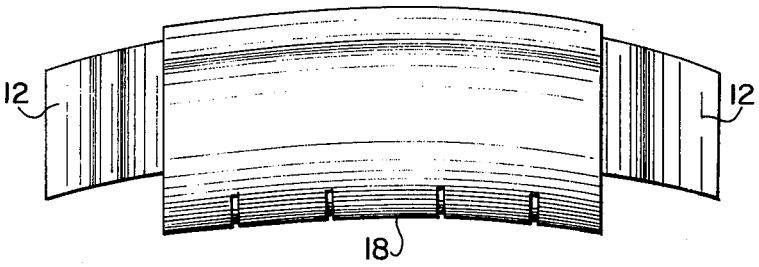
FIG. 2 is a top plan view of the brush which comprises the invention.
Figure 4:
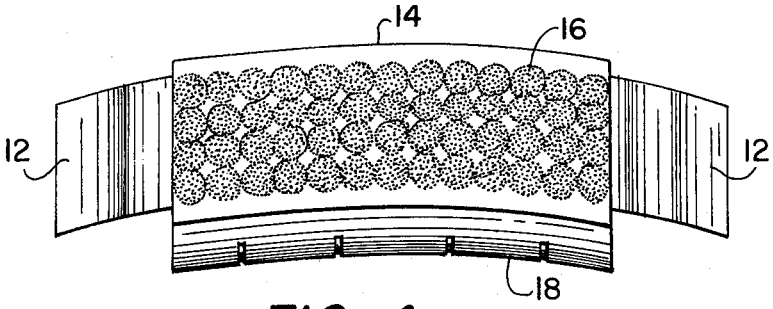
FIG. 4 is a bottom plan view of the brush which comprises the invention.

Referring to FIGS. 2 and 4, the curvature of concave base 14 and the pattern of bristles 16 are shown. This built-in curvature permits brush 10 to follow the contours of the groove of the whitewall, because the curvature approximates the curvature or radius of the tire and correspondingly the groove of the whitewall. Where base 14 is flexible as well as having the built-in curvature, brush 10 is able to easily conform to the curvature of the groove of the whitewall and to hereby permit the cleaning of the entire whitewall of a tire in a single step without the necessity of lifting the brush from the groove.

Figure 3:
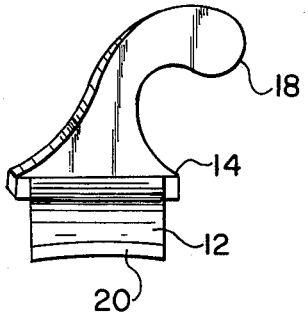
FIG. 3 is a side view of the brush which comprises the invention.

Referring to FIG. 3, there is shown the shape of handle 18. Handle 18 is tilted and arched so as to form an acute angle with the plane of base 14. This tilting and arching of the handle facilitates gripping of the handle and thus simplifies use of brush 10. The handle also advantageously allows the user to rotate the brush fully around the whitewall strip without a loss in the pressure being applied in the cleaning of the strip.

The maintenance of pressure in the cleaning of the whitewall is also aided by the cooperation of the groove of the tire and the resilient guide means. The guide means serve to position the brush within the whitewall's grooves. The guide means further align the bristles of the brush with respect to the whitewall, in order to permit an effective utilization of all of the force applied by the user in the step of cleaning, rather than a dilution of the cleaning power to maintain the brushes alignment.

In order to permit a natural stroke by the brush's user, the handle 18 of the brush is contoured into the general shape of a hand. The user is able to obtain a secure grip on the brush which facilitates transmission of cleaning action from the hand of the user to the base of the brush, regardless of the brush's position in its rotation about the tire.

The inclination of the handle provides further means for directing a substantial quantity of the power generated by the user into effective cleaning strokes. The inclination of the handle allows the wrist to assume a natural position as it projects the brush over the whitewall. By not forcing the wrist into an unnatural bent position, the total power flowing from the arm can be transmitted through the wrist and to the brush. This maintenance of the wrist in a straight position also allows greater force to be used for rubbing the whitewall, since power is not diverted in unnecessary ajustments of the wrist to maintain the brush or the whitewall as the brush moves around the tire.

The invention may be embodied in other specific forms without departing from the spirit or central characteristics thereof. The present embodiments are therefore to be considered as illustrative and not restrictive, the scope of the invention being indicated by the dependent claims rather than by the foregoing description, and all changes which come within the meaning and range of equivalency of the claims are therefore intended to be embraced therein.

I claim:

1. A brush for cleaning the whitewall portion of a whitewall tire, the tire being of the type wherein said whitewall portion is generally circular and is recessed to define a groove, said brush comprising a base having a top and bottom, a plurality of outwardly projecting bristles mounted on said base so as to define an arcuate scrubbing surface having a width and radius of curvature corresponding to the width and radius of curvature, respectively, of the whitewall groove, a handle connected to said base top, and a resilient guide flap projecting longitudinally outwardly from each end of said base; said guide flaps having a width corresponding to the width of the whitewall groove and being curved such that the lateral edges thereof define S-curves and the distal end portions ride in the whitewall groove in spring-biased engagement therewith when said brush is in operative contact with the tire.

2. The brush of claim 1 wherein said handle is curvilinearly configured so as to define a generally upstanding portion which tapers in thickness to form a relatively narrow neck, as viewed in transverse cross-section, which is spaced from said base, and a curved grip portion extending from said neck such that said grip portion extends laterally outwardly with respect to said upstanding portion and toward one lateral side of said base such that the distal portion of said grip portion is disposed relatively outwardly of and spaced from said base so as to facilitate circumferential movement of said brush with respect to the whitewall tire portion.

3. The brush of claim 2 wherein said grip portion is reflexively curved so as to define a gripping surface having a convex upper portion and a concave lower portion which allows said handle to be gripped so as to facilitate said circumferential movement of said brush.

4. The brush of claim 3 wherein said upstanding portion is inclined toward said one lateral side of said base.

* * * * *